US011795412B1

(12) United States Patent
Edwards et al.

(10) Patent No.: US 11,795,412 B1
(45) Date of Patent: Oct. 24, 2023

(54) LUBRICATING COMPOSITION FOR INDUSTRIAL GEAR FLUIDS

(71) Applicant: Afton Chemical Corporation, Richmond, VA (US)

(72) Inventors: David Edwards, Richmond, VA (US); Helen Ryan, Sheen (GB)

(73) Assignee: AFTON CHEMICAL CORPORATION, Richmond, VA (US)

( * ) Notice: Subject to any disclaimer, the term of this patent is extended or adjusted under 35 U.S.C. 154(b) by 0 days.

(21) Appl. No.: 18/178,126

(22) Filed: Mar. 3, 2023

(51) Int. Cl.
*C10M 135/20* (2006.01)
*C10N 40/04* (2006.01)

(52) U.S. Cl.
CPC ..... *C10M 135/20* (2013.01); *C10M 2219/08* (2013.01); *C10N 2040/04* (2013.01)

(58) Field of Classification Search
CPC ..... C10M 135/20; C10M 2219/08; C10N 2040/04
USPC ..... 508/569
See application file for complete search history.

(56) References Cited

U.S. PATENT DOCUMENTS 2,129,264 A 9/1938 Baxter et al.
2,237,625 A 4/1941 Olin
2,237,627 A 4/1941 Olin
2,425,755 A 8/1947 Roberts et al.
2,425,845 A 8/1947 Toussaint et al.
2,448,664 A 9/1948 Fife et al.
2,457,139 A 12/1948 Fife et al.
2,475,755 A 7/1949 Pearson
2,527,948 A 10/1950 Lyon, Jr. et al.
2,568,876 A 9/1951 White et al.
2,695,316 A 11/1954 Mcbride
2,749,311 A 6/1956 Sabol et al.
2,760,933 A 8/1956 Fields et al.
2,765,289 A 10/1956 Fields et al.
2,850,453 A 9/1958 Fields
2,886,423 A 5/1959 Kozikowski
2,910,439 A 10/1959 Fields
2,995,569 A 8/1961 Hamilton et al.
3,015,668 A 1/1962 Kozikowski
3,022,351 A 2/1962 Mihm et al.
3,027,246 A 3/1962 Bartlett
3,092,474 A 6/1963 Ebner
3,172,892 A 3/1965 Le Suer et al.
3,198,613 A 8/1965 Udelhofen
3,202,678 A 8/1965 Stuart et al.
3,216,936 A 11/1965 Le Suer
3,219,666 A 11/1965 Normal et al.
3,254,025 A 5/1966 Le Suer
3,272,746 A 9/1966 Le Suer et al.
3,308,166 A 3/1967 Michel et al.
3,361,673 A 1/1968 Le Suer et al.
3,392,201 A 7/1968 Warner
3,468,640 A 9/1969 Barusch et al.
3,471,404 A 10/1969 Myers
3,663,561 A 5/1972 Blaha
3,673,090 A 6/1972 Waldbillig et al.
3,676,089 A 7/1972 Morris et al.
3,703,504 A 11/1972 Horodysky
3,703,505 A 11/1972 Horodysky et al.
3,778,371 A 12/1973 Malec
3,796,661 A 3/1974 Suratwala et al.
3,840,549 A 10/1974 Blaha et al.
3,862,798 A 1/1975 Hopkins
3,873,454 A 3/1975 Horodysky et al.
4,038,043 A 7/1977 Garth
4,056,531 A 11/1977 Malec
4,067,698 A 1/1978 Steckel
4,119,549 A 10/1978 Davis
4,119,550 A 10/1978 Davis et al.
4,147,640 A 4/1979 Jayne et al.
4,152,499 A 5/1979 Boerzel et al.
4,171,959 A 10/1979 Vartanian
4,191,659 A 3/1980 Davis
4,204,969 A 5/1980 Papay et al.
4,218,332 A 8/1980 Schwab et al.
4,231,759 A 11/1980 Udelhofen et al.
4,234,435 A 11/1980 Meinhardt et al.
4,240,958 A 12/1980 Braid
4,248,719 A 2/1981 Chafetz et al.
4,253,980 A 3/1981 Hammond et al.
4,326,973 A 4/1982 Hammond et al.
4,338,206 A 7/1982 Hammond et al.
4,344,854 A 8/1982 Davis et al.
4,472,306 A 9/1984 Powers et al.
4,482,357 A 11/1984 Hanlon
4,564,709 A 1/1986 Koyama et al.
4,605,808 A 8/1986 Samson et al.
4,613,341 A 9/1986 Zaweski et al.
4,711,736 A 12/1987 Horodysky et al.
4,729,769 A 3/1988 Schlicht et al.
4,787,916 A 11/1988 Feldman
4,795,576 A 1/1989 Born et al.
4,827,040 A 5/1989 Labat
4,844,714 A 7/1989 Vogel et al.
4,877,416 A 10/1989 Campbell et al.
4,954,274 A 9/1990 Zaweski et al.
4,966,720 A 10/1990 DeGonia et al.
(Continued)

FOREIGN PATENT DOCUMENTS

CA 2089833 A1 8/1993
CN 1256302 A 6/2000
(Continued)

OTHER PUBLICATIONS

Smith, S. Scott et al. Measurement and Control of Fuel Injector Deposits in Direct Injection Gasoline Vehicles, SAE International; Oct. 14, 2013. doi: 10.4271/2013-01-2616.

*Primary Examiner* — Prem C Singh
*Assistant Examiner* — Francis C Campanell
(74) *Attorney, Agent, or Firm* — Honigman LLP

(57) ABSTRACT

A gear fluid composition for lubricating a driveline including a combination of short-chain polysulfide and long-chain polysulfide extreme pressure agents to minimize sulfur loss and to maintain high extreme pressure performance.

20 Claims, No Drawings

(56) References Cited

U.S. PATENT DOCUMENTS 5,024,677 A 6/1991 Wang
5,091,112 A 2/1992 Perozzi et al.
5,174,922 A 12/1992 Perozzi et al.
5,250,174 A 10/1993 Hart
5,254,138 A 10/1993 Kurek
5,266,223 A 11/1993 Song et al.
5,330,667 A 7/1994 Tiffany, III
5,393,309 A 2/1995 Cherpeck
5,410,088 A 4/1995 Harris et al.
5,514,190 A 5/1996 Cunningham et al.
5,518,511 A 5/1996 Russel et al.
5,575,823 A 11/1996 Wallace et al.
5,620,486 A 4/1997 Cherpeck
5,634,951 A 6/1997 Colucci et al.
5,697,988 A 12/1997 Malfer et al.
5,725,612 A 3/1998 Malfer et al.
5,752,989 A 5/1998 Henly et al.
5,756,428 A 5/1998 Emert et al.
5,792,731 A 8/1998 Ichihashi et al.
5,814,111 A 9/1998 Graham et al.
5,873,917 A 2/1999 Daly
5,876,468 A 3/1999 Moreton
6,048,373 A 4/2000 Malfer et al.
6,166,238 A 12/2000 Filipkowski et al.
6,405,711 B1 6/2002 Smith et al.
6,458,172 B1 10/2002 Macduff et al.
6,462,014 B1 10/2002 Johnson
6,475,250 B2 11/2002 Krull et al.
6,548,458 B2 4/2003 Loper
6,642,187 B1 * 11/2003 Schwind ..... C10M 133/52 508/420
6,689,723 B2 2/2004 Sullivan
6,695,890 B1 2/2004 Hazel et al.
6,730,773 B2 5/2004 Heinen
6,800,103 B2 10/2004 Malfer et al.
6,867,171 B2 3/2005 Harrison et al.
6,884,855 B2 4/2005 Nelson et al.
7,297,675 B2 11/2007 Alef
7,402,185 B2 7/2008 Aradi et al.
7,414,013 B2 8/2008 Nelson et al.
7,435,272 B2 10/2008 Aradi et al.
7,601,676 B2 10/2009 Stoneman et al.
7,704,289 B2 4/2010 Alters et al.
7,744,660 B2 6/2010 Burrington et al.
7,766,982 B2 8/2010 Colucci et al.
7,906,470 B2 3/2011 Stevenson et al.
7,947,093 B2 5/2011 Barton et al.
7,951,211 B2 5/2011 Barton et al.
8,097,570 B2 1/2012 Boutout et al.
8,231,695 B2 7/2012 Cunningham et al.
8,425,627 B2 4/2013 Dietz et al.
8,449,630 B2 5/2013 Lange et al.
8,475,541 B2 7/2013 Fang et al.
8,486,876 B2 7/2013 Brewer et al.
8,496,716 B2 7/2013 Lange et al.
8,557,003 B2 10/2013 Malfer et al.
8,778,034 B2 7/2014 Cunningham
8,863,700 B2 10/2014 Fang et al.
8,894,726 B2 11/2014 Fang et al.
8,961,623 B2 2/2015 Stevenson et al.
8,974,551 B1 3/2015 Fang et al.
9,062,265 B2 6/2015 Reid et al.
9,090,850 B1 7/2015 Edwards et al.
9,340,742 B1 5/2016 Fang et al.
9,469,825 B2 10/2016 Tang
11,572,524 B1 2/2023 Lehner
2003/0014910 A1 1/2003 Aradi et al.
2003/0131527 A1 7/2003 Colucci et al.
2004/0029766 A1 2/2004 Frick et al.
2004/0060226 A1 4/2004 Bongart et al.
2004/0167040 A1 8/2004 Dahlmann et al.
2005/0066572 A1 3/2005 Colucci et al.
2005/0120619 A1 6/2005 Koch et al.
2005/0215411 A1 9/2005 Mackney et al.
2006/0070293 A1 4/2006 Lange et al.
2006/0168876 A1 8/2006 Colucci et al.
2006/0196110 A1 9/2006 Schwahn et al.
2006/0196111 A1 9/2006 Colucci et al.
2006/0223716 A1 10/2006 Milner et al.
2006/0272597 A1 12/2006 Burrington et al.
2007/0015681 A1 1/2007 Allef et al.
2007/0193119 A1 8/2007 Hoffman
2007/0245621 A1 10/2007 Malfter et al.
2008/0086936 A1 4/2008 Cunningham et al.
2008/0113890 A1 5/2008 Moreton et al.
2008/0307698 A1 12/2008 Barton et al.
2009/0049740 A1 2/2009 Hurst
2009/0235576 A1 9/2009 Volkel et al.
2009/0282731 A1 11/2009 Malfer et al.
2010/0005706 A1 1/2010 Burgazli et al.
2010/0024289 A1 2/2010 Smith et al.
2010/0037513 A1 2/2010 Petrucci et al.
2010/0037514 A1 2/2010 Malfer et al.
2010/0132253 A1 6/2010 Kaufman et al.
2010/0151396 A1 6/2010 Papachristos et al.
2010/0236510 A1 9/2010 Shea et al.
2011/0162263 A1 7/2011 Vilardo et al.
2011/0185626 A1 8/2011 Barton et al.
2011/0237469 A1 9/2011 Khandekar et al.
2011/0258917 A1 10/2011 Garcia Castro et al.
2011/0302828 A1 12/2011 Fang et al.
2011/0308550 A1 12/2011 Reid
2011/0315107 A1 12/2011 Grabarse et al.
2012/0010112 A1 1/2012 Grabarse et al.
2012/0101017 A1 4/2012 Duggal
2012/0291339 A1 11/2012 Martin et al.
2013/0031827 A1 2/2013 Reid et al.
2013/0031828 A1 2/2013 Reid et al.
2013/0104826 A1 5/2013 Burgess et al.
2013/0220255 A1 8/2013 Fang
2013/0227878 A1 9/2013 Wolf et al.
2013/0233267 A1 9/2013 Barbour
2013/0237466 A1 9/2013 Lange et al.
2013/0247450 A1 9/2013 Wolf
2013/0255139 A1 10/2013 Dolmazon et al.
2013/0296210 A1 11/2013 Hansch et al.
2013/0298948 A1 11/2013 Company et al.
2013/0312318 A1 11/2013 Peretolchin et al.
2013/0324665 A1 12/2013 Shaikh et al.
2013/0333650 A1 12/2013 Fang et al.
2014/0157655 A1 6/2014 Tort et al.
2014/0174390 A1 6/2014 Reid et al.
2015/0033617 A1 2/2015 Arondel et al.
2015/0072908 A1 * 3/2015 Tsujimoto ..... C10M 141/10 508/330
2015/0252277 A1 9/2015 Hansch et al.
2016/0272912 A1 9/2016 Voelkel et al.

FOREIGN PATENT DOCUMENTS

CN 101671584 B 3/2010
EP 0016312 A1 10/1980
EP 0293192 A1 11/1988
EP 0411861 B1 3/1993
EP 1293553 A2 3/2003
EP 1411105 A2 4/2004
EP 1518918 A1 3/2005
EP 1918355 A1 5/2008
EP 2033945 A1 3/2009
EP 1471133 B1 7/2011
EP 2674471 A1 12/2013
EP 2987845 A1 2/2016
GB 0842728 B1 7/1960
GB 1162334 A1 8/1969
GB 1308894 A 3/1973
GB 2493377 A1 2/2013
WO 2004050806 A2 6/2004
WO 2005023965 A1 3/2005
WO 2010132209 A1 11/2010
WO 2013000738 A2 1/2013
WO 2013017889 A1 2/2013
WO 2013070503 A1 5/2013

(56) References Cited

FOREIGN PATENT DOCUMENTS

| | | | |
|---|---|---|---|
| WO | 2013092533 | A1 | 6/2013 |
| WO | 2015011505 | A1 | 1/2015 |
| WO | 2017168312 | A1 | 10/2017 |

* cited by examiner

LUBRICATING COMPOSITION FOR INDUSTRIAL GEAR FLUIDS

TECHNICAL FIELD

The present disclosure relates to lubricating composition for driveline applications including, for example, gears, axles, and/or power transmission fluids having improved characteristics for extreme pressure, friction, and/or sulfur retention.

BACKGROUND

Gears, transmissions, and/or axles for heavy duty or industrial applications commonly require lubricants that provide specific friction characteristics suitable for the desired applications. For instance, axles, transfer cases, differentials, and transmissions are often provided in many heavy duty or industrial vehicles and each requires unique lubricating compositions. In practice, gears and axles for such applications can be operated at full-load capacity and/or with frequent stop-and-go operations putting additional stress and strain on the hardware. Thus, lubricants for heavy duty or industrial gear and axle applications need additive chemistry to reliably protect gears and axles under both the full-load and the stop-and-go operating conditions.

Typically, lubricants for such applications require, for example, the fluid to meet one or more performance characteristics of extreme pressure, antiwear, friction, and/or copper corrosion to suggest but a few of the common requirements of axle or gear fluids. A number of additives may be included in the lubricant to achieve such performance. For instance, such lubricants often include a sulfurized additive to protect gears and other components from wear and scoring. However, the sulfur additives commonly used in such gear oils tend to be volatile resulting in a certain amount of sulfur loss over time. Sulfur loss is undesired for a number of reasons including degraded extreme pressure performance as well as potential environmental concerns.

SUMMARY

In one approach or embodiment, a lubricant composition for a driveline providing good extreme pressure and low sulfur loss is described herein. In one aspect, the lubricating composition includes (a) a first polysulfide extreme pressure agent comprising a mixture of C2-C6 polysulfides including a majority of trisulfides; (b) a second polysulfide extreme pressure agent comprising a mixture of C10-C14 polysulfides including a majority of trisulfides; and wherein a weight ratio of sulfur contributed by the first polysulfide and the second polysulfide is about 0.3 to about 0.8.

In other approaches or embodiments, the lubricant composition of the previous paragraph may be combined with one or more optional features, approaches, or embodiments. These optional features or embodiments may include one or more of the following: wherein said first and said second polysulfide provide between about 0.2 to about 0.5 weight percent sulfur to the lubricating composition; and/or wherein the first polysulfide has about 40 to about 50 weight percent sulfur and the second polysulfide has about 18 to about 30 weight percent sulfur; and/or wherein the first polysulfide has about 1 to about 10 mol percent disulfides and about 51 to about 95 mol percent trisulfides; and/or wherein the second polysulfide has about 1 to about 10 mol percent disulfides and about 51 to about 95 mol percent trisulfides; and/or wherein the first polysulfide has a structure of the formula $R_1—S_X—R_2$, wherein $R_1$ and $R_2$, are independently, a C4 to C6 hydrocarbyl group and x is an integer of at least 2 with a majority of x being 3; and/or wherein $R_1$ and $R_2$ are each C4 hydrocarbyl groups; and/or wherein the first polysulfide includes di-tert-butyl polysulfide; and/or wherein the second polysulfide has a structure of the formula $R_3—S_y—R_4$, wherein $R_3$ and $R_4$, are independently, a C10 to C14 hydrocarbyl group and y is an integer of at least 2 with a majority of y being 3; and/or wherein $R_3$ and $R_4$ are each C12 hydrocarbyl groups; and/or wherein the second polysulfide includes di-tert-dodecyl polysulfide; and/or wherein the lubricant composition has less than about 30 weight percent sulfur loss as measured pursuant to ASTM D2893 and greater than about 200 kgf pursuant to a 4-ball test of ASTM D2596; and/or further comprising about 0.2 to about 0.4 weight percent of the first polysulfide and about 0.8 to about 1.2 weight percent of the second polysulfide; and/or further comprising a weight percent ratio of the first polysulfide to the second polysulfide of about 0.2 to about 0.38.

In other approaches or embodiments of this disclosure, a method of lubricating a driveline to provide good extreme pressure performance and to maintain a low sulfur loss is described herein. In an aspect of this embodiment, the method includes lubricating a driveline component with a lubricating composition including a first polysulfide extreme pressure agent comprising a mixture of C2-C6 polysulfides with a majority of trisulfides and a second polysulfide extreme pressure agent comprising a mixture of C10-C14 polysulfides including a majority of trisulfides, and wherein a weight ratio of sulfur contributed by the first polysulfide and the second polysulfide is about 0.3 to about 0.8.

In other approaches or embodiments, the methods of the previous paragraph may be combined with one or more optional steps, features, or embodiments in any combination. These optional features or embodiments of the method may include one or more of the following: wherein said first and said second polysulfide provide between about 0.2 to about 0.5 weight percent sulfur to the lubricating composition; and/or wherein the first polysulfide has a structure of the formula $R_1—S_X—R_2$, wherein $R_1$ and $R_2$, are independently, a C4 to C6 hydrocarbyl group and x is an integer of at least 2 with a majority of x being 3; and/or wherein the second polysulfide has a structure of the formula $R_3—S_y—R_4$, wherein $R_3$ and $R_4$, are independently, a C10 to C14 hydrocarbyl group and y is an integer of at least 2 with a majority of y being 3; and/or wherein the first polysulfide includes di-tert-butyl polysulfide; and/or wherein the second polysulfide includes di-tert-dodecyl polysulfide; and/or wherein the lubricant composition has less than about 30 weight percent sulfur loss as measured pursuant to ASTM D2893 and greater than about 200 kgf pursuant to a 4-ball test of ASTM D2596.

In further embodiments or approaches, the use of any embodiment of the lubricant as described herein is provided to form a lubricant composition and/or to lubricate a driveline composition and also to have less than about 30 weight percent sulfur loss as measured pursuant to ASTM D2893 and/or greater than about 200 kgf pursuant to a 4-ball test of ASTM D2596

Other embodiments of the present disclosure will be apparent to those skilled in the art from consideration of the specification and practice of the invention disclosed herein. The following definitions of terms are provided in order to clarify the meanings of certain terms as used herein.

The terms "gear oil," "gear fluid," "gear lubricant," "base gear lubricant," "lubricating oil," "lubricant composition,"

"lubricating composition," "lubricant" and "lubricating fluid" refer to a finished lubrication product comprising a major amount of a base oil plus a minor amount of an additive composition as discussed herein. Such gear fluids are for use in extreme pressure situations such as for transmissions and gear drive components having metal-on-metal contact situations, for instance, in a transmission, turbine, and/or a limited-slip differential.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition. All percent numbers herein, unless specified otherwise, is weight percent.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties from about 1 to about 200 carbon atoms. The term "alkenyl" as employed herein refers to straight, branched, cyclic, and/or substituted unsaturated chain moieties from about 3 to about 30 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the molecular weight is determined by gel permeation chromatography (GPC) using commercially available polystyrene standards (with a Mn of about 180 to about 18,000 as the calibration reference). The molecular weight (Mn) for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5 μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1-0.5 weight percent and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

As used herein, any sulfur moiety distributions or ratios were determined using $^{13}$CNMR via a Bruker Avance-3 HD 500 MHz instrument equipped with a 5 mm BBO Prodigy probe (or equivalent). Samples were dissolved in chloroform-d, about 3% wt/wt for the $^{1}$H NMR one-dimensional (1D) and two-dimensional (2D) homonuclear experiments and about 30% wt/wt for the $^{13}$C 1D and 2D heteronuclear experiments. The chloroform-d was used as the chemical shift reference, $d_H$=7.27 and $d_C$=77.0 ppm, respectively. The experiments were conducted at ambient temperature. The direct observe 1D $^{1}$H and $^{13}$C-$^{1}$H decoupled experiments were performed under quantitative conditions using ninety-degree pulse widths, 5×T1 delays and gated $^{1}$H decoupling for the $^{13}$C NMR experiments. In addition, a Distortionless Enhancement by Polarization Transfer (DEPT) experiment, using the 135-degree pulse option was also acquired. The 2D experiments used to assist in structural assignments were Homonuclear Correlated Spectroscopy (COSY), Heteronuclear Single Quantum Coherence (HSQC) and Heteronuclear Multiple Bond Correlation (HMBC). All NMR data was acquired using the Bruker Topspin 3.62 software from Bruker Inc of Billerica MA and processed using ACD/Spectrus Processor 2021.1.3 software from Advanced Chemistry Development, Inc. using standard parameters (or equivalent equipment/software).

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

DETAILED DESCRIPTION

In one approach or embodiment, disclosed herein are lubricating compositions suitable for gear fluids, power transmission fluids, and/or axle applications having up to about 1.0 weight percent of sulfur provided by a mixture of polysulfide extreme pressure agents (in other approaches, the lubricants may have about 0.2 weight percent to about 1.0 weight percent sulfur, about 0.2 to about 0.75 weight percent sulfur, or about 0.2 weight percent to about 0.5 weight percent sulfur from the mixture of polysulfide extreme pressure agents). The sulfur provided by the polysulfide extreme pressure agents has a certain profile of sulfur moieties and each polysulfide of the mixture has a certain profile of organic moieties thereon. In one aspect, the lubricating compositions herein have a combination of at least two or more polysulfide extreme pressure agents with each having a selected sulfur moiety and a selected organic moiety structure configured to minimize sulfur volatility and to maintain high extreme pressure performance in the lubricating compositions.

In one approach or embodiment, the lubricant compositions herein include a first polysulfide extreme pressure agent including a mixture of short chain polysulfides, such as C2-C6 polysulfides, with a majority of first polysulfides being trisulfides and a second polysulfide extreme pressure agent including a mixture of long-chain polysulfides, such as C10-C14 polysulfides, with a majority of the second polysulfides also being trisulfides. In one aspect of the embodiments herein, the lubricating compositions also have a weight ratio of sulfur contributed by the first polysulfide and the second polysulfide of about 0.3 to about 0.8. Lubricating composition including such mixture of polysulfide extreme pressure agents have less than about 30 weight percent sulfur loss (as shown in the Examples below, measured pursuant to the S200 oxidation test of ASTM D2893) and greater than about 200 kgf pursuant to a 4-ball test of ASTM D2596.

In some approaches and embodiments, the first polysulfide extreme pressure agent has a structure of the formula $R_1$—$S_x$—$R_2$, wherein $R_1$ and $R_2$, are independently, short-chain hydrocarbyl groups, such as a C4 to C6 hydrocarbyl group and x is an integer of at least 2 (i.e., at least disulfides) with a majority of x integers being 3 (i.e., mostly trisulfides). In other approaches or embodiments, the second polysulfide extreme pressure agent has a structure of the formula $R_3$—$S_y$—$R_4$, wherein $R_3$ and $R_4$, are independently, long-chain hydrocarbyl groups, such as a C10 to C14 hydrocarbyl group and y is an integer of at least 2 (i.e., at least disulfides) with a majority of y integers being 3 (i.e., mostly trisulfides). Thus, each polysulfide extreme pressure agent is a compound having at least —$S_2$— moieties with a majority the polysulfides having —$S_3$-moieties. In some approaches, each of the polysulfide extreme pressure agents herein may also have less than about 1 weight percent of —$S_4$— and higher moieties. As discussed more below, the selected sulfur contents help with the extreme pressure performance, and the selected organic groups and, in particular, the ratio of the short chain and long chain organic groups helps aid with sulfur retention.

First Polysulfide Extreme Pressure Agent

The first polysulfide extreme pressure agent (also referred to herein as EP Agent A) is a dihydrocarbyl sulfide compound having a structure of the formula $R_1$—$S_x$—$R_2$ wherein $R_1$ and $R_2$, independently, are short-chain hydrocarbyl groups, preferably C2 to C6 hydrocarbyl groups (in other approaches, C3 to C6 hydrocarbyl groups or C4 to C6 hydrocarbyl groups) and x is an integer of at least 2 and preferably, a majority of the x integers are 3. That is, each hydrocarbyl group of the first polysulfide extreme pressure agent has 2 to 6 carbon atoms, preferably from 4 to 6 carbon atoms, or more preferably, 4 carbon atoms. In approaches, each hydrocarbyl group of the organic sulfide compound may be aromatic or aliphatic, preferably, the hydrocarbyl groups may be aliphatic groups such as alkyl, alkenyl, cycloalkyl, cycloalkylalkyl, aryl, aralkyl, cycloalkenyl, or the like, and most preferably, the hydrocarbyl groups are alkyl groups having the noted amount of carbon atoms. Suitable alkyl groups may be linear or branched ethyl, propyl, butyl, pentyl, and/or hexyl groups. As discussed more below, the hydrocarbyl groups may be derived from suitable olefins and may have from 2 to 6 carbon atoms or other ranges as set forth above. Preferably, the first polysulfide extreme pressure agent has C4 hydrocarbyl groups, and most preferably, is a di-tert-butyl polysulfide.

Suitable olefins for preparing the first polysulfide extreme pressure agent herein may be mono or disubstituted monoolefins that include 2 to 6 carbon atoms. A disubstituted monoolefins is an olefin having at least one double bonded carbon atom having two alkyl substituents. Examples of suitable olefins for deriving the first polysulfide extreme pressure agent include ethylene, propylene, butylene, isobutylene, 2-methyl-2-pentene, 2-methyl-2-butene, 2-methyl-1-butene, diisobutylene, triisobutylene, and mixtures thereof as well as dimers, trimers, tetramers, and mixtures thereof so that the formed polysulfide has the C2 to C6 organic groups thereon.

In approaches or embodiments, the first polysulfide extreme pressure agent may be prepared by reacting molten sulfur in predetermined quantities in the presence of aqueous sodium hydrogen sulfide under high pressure conditions with the desired olefin. Preferably, the source of sulfur for forming the first polysulfide is substantially devoid of sulfur chlorides, hydrogen sulfides, and combinations thereof and, in this context, reactions herein have about 0.1 weight percent or less, about 0.05 weight percent or less, about 0.01 weight percent or less, or no sulfur chlorides, hydrogen sulfides, or the like. The first polysulfide extreme pressure agent may be obtained at temperatures of about 75° C. to about 300° C., preferably from about 120° to about 220° C., and more preferably about 120° C. to about 150° C. Suitable mole ratios of sulfur to hydrosulfide may range from about 20:1 to about 0.25:1. The mole ratio of sulfur plus hydrosulfide to olefin may range from about 5:1 to about 0.5:1. The high pressure may vary from about 100 psig to 2000 psig or more. Reaction times vary and may range from about 2 to about 24 hours, preferably less than about 8 hours, and may be 1 to 4 hours. While any suitable olefin may be used, selection of the olefin is needed to achieve the short-chain hydrocarbyl groups as noted above. For example, olefins containing from 2 to about 6 carbons are useful feedstocks as needed to achieve the desired short-chain hydrocarbyl groups in the final product and, preferably, isotubylene is used for the first polysulfide extreme pressure agent. The selected olefin or mixture of olefins may optionally be reacted with a preformed mixture of sulfurized, aqueous hydrosulfide prepared by the direct sulfurization of aqueous sodium hydrosulfide. The reaction may suitably be carried out with a sequential addition of reactants. An aqueous solution of any suitable alkali metal or alkaline earth metal salt of hydrosulfide may be employed. Aqueous solutions of sodium hydrosulfide are preferred, and concentrated solutions of sodium hydrosulfide are preferred over dilute solutions.

In some approaches or embodiments, the polysulfide product formed from the above reaction may then be treated with an aqueous solution of caustic (i.e., sodium hydroxide) and/or an alkali metal sulfide, such as sodium or potassium sulfide and, in some instances, sodium sulfide, which can be prepared, for example, by mixing aqueous sodium hydrosulfide and caustic solutions (such as aqueous sodium hydroxide) in amounts effective to produce the desired sulfide profiles/ratios in the final product. The caustic may be a 40 to 60 percent solution of the metal hydroxide, such as sodium hydroxide. The solution can contain co-solvents such as methanol. The caustic and/or sodium sulfide solution and the above formed polysulfide may be combined in a stirred reactor and heated under an inert atmosphere such as nitrogen at temperatures up to about 100° C., such as about 50° to about 100° C. (preferably about 90° C. to about 100°

C.) for about 30 minutes to about 4 hours and, in some instances, about 1 to about 2 hours. The reaction mixture is then allowed to cool and the organic product separated on top of the aqueous layer may be recovered. The amount of caustic may be varied as needed to form each of the reaction products and sulfur profiles/ratios thereof. Alternatively, the above-formed polysulfide product can be distilled using suitable distillation equipment to collect suitable fractions containing the trisulfide and disulfide content as noted herein.

The formed first polysulfide extreme pressure agent is mostly trisulfides and may have about 1 to about 10 mol percent disulfides, about 51 to about 99 mol percent trisulfides, and about 1 mol percent or less of tetrasulfides or higher sulfides. In other approaches or embodiments, the first polysulfide extreme pressure agent has about 51 to about 95 mol percent trisulfides, about 65 to about 95 mol percent trisulfides, about 75 to about 95 mol percent trisulfides, or about 85 to about 95 mol percent trisulfides. In other approaches or embodiments, the first polysulfide extreme pressure agent may also have, on a weight basis, about 40 to about 50 weight percent sulfur, in other approaches, about 42 to about 48 weight percent sulfur, or in yet further approaches, about 42 to about 46 weight percent sulfur. As noted above, any embodiment herein of the first polysulfide extreme pressure agent has the noted short-chain organic groups that are preferably a C2 to C6 hydrocarbyl groups, more preferably, C3 to C6 hydrocarbyl groups, even more preferably C4 hydrocarbyl, and most preferably tert-butyl groups.

Second Polysulfide Extreme Pressure Agent

The second polysulfide extreme pressure agent (also referred to herein as EP Agent B) is also a dihydrocarbyl sulfide compound and has a structure of the formula $R_3$—$S_y$—$R_4$ wherein $R_3$ and $R_4$, independently, are long-chain hydrocarbyl groups, preferably C10 to C14 hydrocarbyl groups and y is an integer of at least 2 (and preferably, a majority of the y integers are 3). That is, each hydrocarbyl group of the second polysulfide extreme pressure agent has 10 to 14 carbon atoms, preferably from 12 to 14 carbon atoms, or more preferably, 12 carbon atoms. In approaches, each hydrocarbyl group of this second organic sulfide compound may be aromatic or aliphatic, preferably, the hydrocarbyl groups may be aliphatic groups such as alkyl, alkenyl, cycloalkyl, cycloalkylalkyl, aryl, aralkyl, cycloalkenyl, or the like, and most preferably, the hydrocarbyl groups are alkyl groups having the noted amount of carbon atoms. Suitable alkyl groups for the second polysulfide extreme pressure agent may be linear or branched decyl, undecyl, dodecyl, tridecyl, and/or tetradecyl groups. In such approaches, the hydrocarbyl groups may be derived from a suitable olefin and/or hydrocarbyl mercaptan that may have from 10 to 14 carbon atoms or other ranges are set forth above. Preferably, the second polysulfide extreme pressure agent has C12 hydrocarbyl groups, and most preferably, is di-tert-dodecyl polysulfide.

In one embodiment, the second polysulfide extreme pressure agent can be prepared from elemental sulfur and a suitable hydrocarbyl mercaptan. Suitable mercaptans for preparing the second polysulfide extreme pressure agent herein may be mercaptans that include 10 to 14 carbon atoms. Examples of suitable mercaptans include those having linear or branched decene, undecene, dodecene, tridecene, tetradecene hydrocarbyl groups as well as dimers, trimers, tetramers, and mixtures thereof so that the formed polysulfide has the C10 to C14 organic groups thereon.

In approaches or embodiments, the second polysulfide extreme pressure agent herein may be prepared by reacting, optionally under super-atmospheric pressure, one or more of the above hydrocarbyl mercaptans with a source of sulfur (preferably, elemental sulfur or molten sulfur) in the presence, or absence, of a catalyst, such as an optional alkyl amine catalyst, followed by removal of low boiling materials. Preferably, the source of sulfur for the second polysulfide is also substantially devoid of sulfur chlorides, hydrogen sulfides, and combinations thereof and, in this context, reactions herein have about 0.1 weight percent or less, about 0.05 weight percent or less, about 0.01 weight percent or less, or no sulfur chlorides, hydrogen sulfides, or the like.

In embodiments, the second polysulfide extreme pressure agent herein may be obtained, for example, with the hydrocarbyl mercaptan combined or reacted with elemental sulfur in ratios including, but not limited to, about 2:1 to about 1:2 moles of hydrocarbyl mercaptan to grams of sulfur in an autoclave or other reaction vessel that is suitable for conducting super-atmospheric pressure and elevated temperature reactions. In approaches, the reaction can be carried out at temperatures from about 80° C. to about 200° C., pressures from about 250 to about 1,000 psi, and for reaction times of about 2 to about 30 hours (or as needed) until the elemental sulfur is consumed to achieve the desired sulfur levels for the polysulfide.

The reaction can be carried with or without a catalyst. If used, suitable catalysts may include amines and sulfur compounds such as dithiocarbamate salts and mercaptans such as, but not limited to, n-butylamine, n-octylamine, triethylamine, tetramethylthiuram disulfide, and mercaptobenzothiazole, and the like. The catalysts may be used, if needed but not limited to, amounts of about 0.01 to about 5.0 weight percent of the reaction mixture or other amounts suitable for the particular application and sulfur levels. The reaction may be carried out in the absence of oxygen. In some approaches, the reaction may include non-reactive solvents, such as heptane, dichloromethane, and the like, or combinations thereof.

In some approaches or embodiments, the above sulfurized product may then be treated with an aqueous solution of caustic (sodium hydroxide) and/or alkali metal sulfide, such as sodium or potassium sulfide and, in some instances, sodium sulfide, which can be prepared, for example, by mixing aqueous sodium hydrosulfide and caustic solutions (such as aqueous sodium hydroxide) in amounts effective to produce the desired sulfide profiles/ratios. The solution can contain co-solvents such as methanol. The caustic and/or sodium sulfide solution and the sulfurized intermediate may be combined in a stirred reactor and heated under an inert atmosphere such as nitrogen at temperatures up to about 100° C., such as about 50° to about 100° C. for about 30 minutes to about 4 hours and, in some instances, about 1 to about 2 hours. The reaction mixture is then allowed to cool and the organic product separated on top of the aqueous layer may be recovered. In approaches, the caustic solution may be about 40 to about 60 weight percent of the alkali metal hydroxide (i.e., sodium hydroxide). The amount of caustic may also be varied as needed to form each of the reaction products and sulfur profiles/ratios herein. Alternatively, the sulfurized polysulfide formed above can also be distilled using suitable distillation equipment to collect suitable fractions containing the trisulfide and disulfide content as noted herein.

The formed second polysulfide extreme pressure agent has a majority of trisulfide groups and may have about 1 to about 10 mol percent disulfides, about 51 to about 99 mol percent trisulfides, and about 1 mol percent or less of tetrasulfides or higher sulfides. In other approaches or embodiments, the second polysulfide extreme pressure agent may have about 51 to about 95 mol percent trisulfides, about 65 to about 95 mol percent trisulfides, about 75 to about 95 mol percent trisulfides, or about 85 to about 95 mol percent trisulfides. In some approaches or embodiments, the second polysulfide extreme pressure agent has, on a weight basis, about 18 to about 30 weight percent sulfur, in other approaches, about 18 to about 28 weight percent sulfur, or in yet further approaches, about 20 to about 26 weight percent sulfur. As noted above, any embodiment herein of the second polysulfide extreme pressure agent has the noted long-chain organic groups that are preferably C10 to C14 hydrocarbyl groups, more preferably C12 hydrocarbyl groups, and most preferably, tert-dodecyl groups.

Lubricating Compositions

The lubricating compositions herein include a mixture of the first and the second polysulfide extreme pressure agents as described above and in amounts configured to minimize any sulfur loss and maintain high extreme pressure performance. In approaches or embodiments, for example, the lubricating compositions include (a) the first polysulfide extreme pressure agent comprising a mixture of C2-C6 polysulfides including a majority of trisulfides as described above and (b) the second polysulfide extreme pressure agent comprising a mixture of C10-C14 polysulfides including a majority of trisulfides as also described above.

The combined first and said second polysulfide extreme pressure agents may provide up to about 1 weight percent sulfur and, preferably, about 0.2 to about 0.5 weight percent sulfur to the lubricating composition (in other approaches, about 0.3 to about 0.4 weight percent sulfur). In some approaches or embodiments, the sulfur is provided by each polysulfide in a specific sulfur ratio configured to achieve the low sulfur loss and maintain the extreme pressure performance. In embodiments, a weight ratio of sulfur contributed by the first polysulfide and the second polysulfide is about 0.3 to about 0.8, in other embodiments, about 0.4 to about 0.8, in further embodiments, about 0.45 to about 0.75.

In yet other approaches or embodiments, a treat rate or weight percent of the polysulfide extreme pressure agents in the lubricant compositions herein may include (a) about 0.2 to about 0.4 weight percent of the first polysulfide (EP Agent A) and (b) about 0.8 to about 1.2 weight percent of the second polysulfide (EP Agent B). In other approaches, a weight percent ratio of the first polysulfide to the second polysulfide may be about 0.2 to about 0.38.

Such combinations of the first and the second polysulfide extreme pressure agent enables the lubricant compositions herein to have less than about 30 weight percent sulfur loss (as shown in the Examples below, measured pursuant to the S200 oxidation test of ASTM D2893) and high extreme pressure performance with greater than about 200 kgf pursuant to a 4-ball test of ASTM D2596. In other approaches, sulfur loss of the lubricants herein is only about 20 to about 30 weight percent (or about 21 to 28 weight percent) with strong 4-ball performance of about 200 kgf to about 225 kgf.

Base Oil

In one approach, suitable base oils for use in the lubricating compositions or gear fluids herein include mineral oils, synthetic oils, and include all common mineral oil basestocks. The mineral oil may be naphthenic or paraffinic. The mineral oil may be refined by conventional methodology using acid, alkali, and clay or other agents such as aluminium chloride, or may be an extracted oil produced, e.g. by solvent extraction with solvents such as phenol, sulfur dioxide, furfural or dichlorodiethyl ether. The mineral oil may be hydrotreated or hydrofined, dewaxed by chilling or catalytic dewaxing processes, or hydrocracked, such as the Yubase® family of hydrockracked base oils from SK Innovation Co., Ltd. (Seoul, Korea). The mineral oil may be produced from natural crude sources or be composed of isomerized wax materials or residues of other refining processes.

The base oil or base oil of lubricating viscosity used in the compositions herein may be selected from any suitable base oil for driveline or gear oil applications. Examples include the base oils in Groups I-V as specified in the American Petroleum Institute (API) Base Oil Interchangeability Guidelines. These three base oil groups are as follows:

TABLE 1

Base oil Types

| Base Oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks and may be preferred for the driveline or gear fluids of the present application. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Suitable oils may be derived from hydrocracking, hydrogenation, hydrofinishing, unrefined, refined, and re-refined oils, and mixtures thereof. In some approaches, the base oil may be a blend of Group I and Group II oils and the blend may be about 0% to about 100% of the Group I oil, about 0% to about 100% of the Group II oil, about 0% to about 100% of the Group III oil, or various blends of Group I and II, Group I and III, or Group II and III oil blends.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

The major amount of base oil included in the gear fluids herein may be selected from the group consisting of Group I, Group II, a Group HI, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group I, a Group II, and a combination of two or more of the foregoing, and wherein the major amount of base oil is other than base oils that arise from provision of additive components or viscosity index improvers in the composition.

The base oil may also be any of the synthetic base oils. Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The amount of the base oil of lubricating viscosity in the compositions herein may be the balance remaining after subtracting from 100 wt % the sum of the amount of the performance additives. For example, the oil of lubricating viscosity that may be present in a finished fluid may be a "major amount," such as greater than about 50 wt %, greater than about 60 wt %, greater than about 70 wt %, greater than about 80 wt %, greater than about 85 wt %, greater than about 90 wt %, or greater than about 95 wt %.

In some approaches, a preferred base oil or base oil of lubricating viscosity has less than about 25 ppm sulfur, a viscosity index greater than about 120 ppm, and a kinematic viscosity at about 100° C. of about 2 to about 8 cSt. In other approaches, the base oil of lubricating viscosity has less than about 25 ppm sulfur, a viscosity index greater than 120, and a kinematic viscosity at 100° C. of about 4 cSt. The base oil may have CP (paraffinic carbon content) of greater than 40%, greater than 45%, greater than 50%, greater than 55%, or greater than 90%. The base oil may have a CA (aromatic carbon content) of less than 5%, less than 3%, or less than 1%. The base oil may have a CN (naphthenic carbon content) of less than 60%, less than 55%, less than 50%, or less than 50% and greater than 30%. The base oil may have a ratio of 1 ring naphthenes to 2-6 ring naphthenes of less than 2 or less than 1.5 or less than 1.

A suitable driveline, axle, or gear lubricant composition herein may include additive components in the ranges listed in the following Table 2.

TABLE 2

Suitable and Preferred Driveline, Axle, or Gear Fluid Compositions

| Component | wt % (Suitable Embodiments) | wt % (Other Embodiments) |
|---|---|---|
| EP Agent A | 0.25-0.65 | 0.35-0.35 |
| EP Agent B | 0.5-2.0 | 0.8-1.5 |
| Thiadiazole or derivative thereof | 0.1-1.0 | 0.1-0.5 |
| Phosphorous containing friction modifier | 0.1-1.0 | 0.1-1.0 |
| Antioxidant(s) | 0.1-5.0 | 0.01-4.0 |
| Detergent(s) | 0.0-15.0 | 1.0-8.0 |
| Corrosion inhibitor(s) | 0.0-5.0 | 0.1-3.0 |
| Ash-free phosphorus compound(s) | 0.0-15.0 | 0.1-5.0 |
| Antifoaming agent(s) | 0.0-1.0 | 0.001-0.5 |
| Antiwear agent(s) | 0.0-1.0 | 0.0-0.8 |
| Pour point depressant(s) | 0.0-1.0 | 0.01-0.5 |
| Viscosity index improver(s) | 0.0-20.0 | 0.1-10.0 |
| Dispersants | 0.0-10.0 | 1.0-6.0 |
| Dispersant viscosity index improver(s) | 0.0-10.0 | 0.0-5.0 |
| Friction modifier(s) | 0.0-10.0 | 0.01-4.0 |
| Extreme Pressure Agent | 0.0-1.05 | 0.035-.35 |
| Base oil(s) | Balance | Balance |
| Total | 100 | 100 |

The percentages of each component above represent the weight percent of each component, based upon the weight of the total final additive or lubricating oil composition. The balance of the lubricating oil composition consists of one or more base oils or solvents. Additives used in formulating the compositions described herein may be blended into the base oil or solvent individually or in various sub-combinations. However, it may be suitable to blend all of the components concurrently using an additive concentrate (i.e., additives plus a diluent, such as a hydrocarbon solvent).

The lubricating composition described herein may be formulated to provide lubrication, enhanced friction performance properties, and improved copper corrosion for various applications. The driveline lubricating compositions herein may be used for lubricating a machine part, such as a gear. Lubricating fluids according to the present disclosure can be used in gear applications, such as industrial gear applications, automotive gear applications, axles, and stationary gearboxes. Gear-types can include, but are not limited to, spur, spiral, worm, rack and pinion, involute, bevel, helical, planetary, and hypoid gears and as well as limited-slip applications and differentials. The driveline lubricating compositions disclosed herein are also suitable for automatic or manual transmissions, including step automatic transmissions, continuously variable transmissions, semi-automatic transmissions, automated manual transmissions, toroidal transmissions, and dual clutch transmissions. The driveline lubricating compositions herein are particularly suited for use in axles, transfer cases, differentials, such as straight differentials, turning differentials, limited-slip differentials, clutch-type differentials, and locking differentials, and the like.

Optional Additives

In other approaches, the lubricant including such additives noted above may also include one or more optional components so long as such components and amounts thereof do not impact the performance characteristics as described in the above paragraphs. These optional components are described in the following paragraphs.

Phosphorus-Containing Compounds

The lubricant composition herein may comprise one or more phosphorus-containing compounds that may impart anti-wear benefits to the fluid. The one or more phosphorus-containing compounds may be present in the lubricating oil composition in an amount ranging from about 0 wt % to about 15 wt %, or about 0.01 wt % to about 10 wt %, or about 0.05 wt % to about 5 wt %, or about 0.1 wt % to about 3 wt % of the lubricating oil composition. The phosphorus-containing compound may provide up to 5000 ppm phosphorus, or from about 50 to about 5000 ppm phosphorus, or from about 300 to about 1500 ppm phosphorus, or up to 600 ppm phosphorus, or up to 900 ppm phosphorus to the lubricant composition.

The one or more phosphorus-containing compounds may include ashless phosphorus-containing compounds. Examples of suitable phosphorus-containing compound include, but are not limited to, thiophosphates, dithiophosphates, phosphates, phosphoric acid esters, phosphate esters, phosphites, phosphonates, phosphorus-containing carboxylic esters, ethers, or amides salts thereof, and mixtures thereof. Phosphorus containing anti-wear agents are more fully described in European Patent 0612839.

It should be noted that often the term phosphonate and phosphite are used often interchangeably in the lubricant industry. For example, dibutyl hydrogen phosphonate is often referred to as dibutyl hydrogen phosphite. It is within the scope of the present invention for the inventive lubricant composition to include a phosphorus-containing compound that may be referred to as either a phosphite or a phosphonate.

In any of the above described phosphorus-containing compounds, the compound may have about 5 to about 20 weight percent phosphorus, or about 5 to about 15 weight percent phosphorus, or about 8 to about 16 weight percent phosphorus, or about 6 to about 9 weight percent phosphorus.

The inclusion of the phosphorus-containing compound in combination with the above described dispersant to a lubricant compositions unexpectedly imparts positive frictional characteristics, such as a low friction coefficient, to the lubricant composition. The inventive effect is even further pronounced in some cases where the phosphorus-containing compound, on its own, imparts negative frictional characteristics to the fluid. When these relatively poor friction reducing phosphorus-containing compounds are combined with the olefin copolymer dispersant described herein, the lubricant composition has an improved, i.e., lower, friction coefficient. That is, the dispersants herein tend to transform fluids containing phosphorus-containing compounds having relatively poor friction coefficients into fluids with improved frictional properties.

This improvement in frictional properties of the lubricating compositions including the phosphorus-containing compounds and the olefin copolymer dispersant described herein is surprising because the frictional properties of the fluid are better than combinations of the phosphorus-containing compounds in combination with other types of dispersants, including polyisobutylene succinimide dispersants and olefin copolymer succinimide dispersants that do not have the specified characteristics of the copolymers described above.

Another type of phosphorus-containing compound that when combined with the olefin copolymer dispersant herein imparts improved frictional characteristics to a lubricating composition is an ashless (metal free) phosphorus-containing compound.

In some embodiments, the ashless phosphorus-containing compound may be dialkyl dithiophosphate ester, amyl acid phosphate, diamyl acid phosphate, dibutyl hydrogen phosphonate, dimethyl octadecyl phosphonate, salts thereof, and mixtures thereof.

The ashless phosphorus-containing compound may be have the formula:

(Formula XIV)

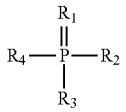

wherein R1 is S or O; R2 is —OR, —OH, or —R"; R3 is —OR", —OH, or SR'"C(O)OH; $R_4$ is —OR"; R'" is C 1 to C3 branched or linear alkyl chain; and R" is a C1 to C18 hydrocarbyl chain. When the phosphorous-containing compound has the structure shown in Formula XIV, the compound may have about 8 to about 16 weight percent phosphorus.

In some embodiments the lubricant composition comprises a phosphorus-containing compound of Formula XIV wherein R1 is S; R2 is —OR"; R3 is S R'"COOH; R4 is —OR"; R'" is C3 branched alkyl chain; R" is C4; and wherein the phosphorus-containing compound is present in an amount to deliver between 80-900 ppm phosphorus to the lubricant composition.

In another embodiment, the lubricant composition comprises a phosphorus-containing compound of Formula XIV wherein R1 is O; R2 is —OH; R3 is —OR" or —OH; R4 is —OR"; R" is C5; and wherein phosphorus-containing compound is present in an amount to deliver between 80-1500 ppm phosphorus to the lubricant composition.

In yet another embodiment, the lubricant composition comprises a phosphorus-containing compound of Formula XIV wherein R1 is O; R2 is OR"; R3 is H; R4 is —OR"; R" is C4; and wherein the one or more phosphorus-containing compound(s) is present in an amount to deliver between 80-1550 ppm phosphorus to the lubricant composition.

In other embodiments, the lubricant composition comprises a phosphorus-containing compound of Formula XIV wherein $R_1$ is O; R2 is —R"; R3 is —OCH3 or —OH; R4 is —OCH3; R" is C18; and wherein the one or more phosphorus-containing compound(s) is present in an amount to deliver between 80-850 ppm phosphorus to the lubricant composition.

In some embodiments, the phosphorus-containing compound has the structure shown in Formula XIV and delivers about 80 to about 4500 ppm phosphorus to the lubricant composition. In other embodiments, the phosphorus-containing compound is present in an amount to deliver between about 150 and about 1500 ppm phosphorus, or between about 300 and about 900 ppm phosphorus, or between about 800 to 1600 ppm phosphorus, or about 900 to about 1800 ppm phosphorus, to the lubricant composition.

Anti-wear Agents

The lubricant composition may also include anti-wear agents that are non-phosphorus-containing compounds. Examples of such antiwear agents include borate esters, borate epoxides, thiocarbamate compounds (including thiocarbamate esters, alkylene-coupled thiocarbamates, and bis (S-alkyldithiocarbamyl)disulfides, thiocarbamate amides, thiocarbamic ethers, alkylene-coupled thiocarbamates, and bis(S-alkyldithiocarbamyl) disulfides, and mixtures thereof), sulfurized olefins, tridecyl adipate, titanium compounds, and long chain derivatives of hydroxyl carboxylic acids, such as tartrate derivatives, tartramides, tartrimides, citrates, and mixtures thereof. A suitable thiocarbamate compound is molybdenum dithiocarbamate. Suitable tartrate derivatives or tartrimides may contain alkyl-ester groups, where the sum of carbon atoms on the alkyl groups may be at least 8. The tartrate derivative or tartrimide may contain alkyl-ester groups, where the sum of carbon atoms on the alkyl groups may be at least 8. The antiwear agent may in one embodiment include a citrate. The additional anti-wear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Extreme Pressure Agents

The lubricant compositions of the disclosure may also contain other extreme pressure agent(s) so long as the lubricating compositions herein include the noted amounts and profiles set forth herein. The optional extreme pressure agent may contain sulfur and may contain at least 12 percent by weight sulfur.

A wide variety of sulfur-containing extreme pressure agents are suitable and include sulfurized animal or vegetable fats or oils, sulfurized animal or vegetable fatty acid esters, fully or partially esterified esters of trivalent or pentavalent acids of phosphorus, sulfurized olefins (see, for example U.S. Pat. Nos. 2,995,569; 3,673,090; 3,703,504; 3,703,505; 3,796,661; 3,873,454 4,119,549; 4,119,550; 4,147,640; 4,191,659; 4,240,958; 4,344,854; 4,472,306; and 4,711,736), dihydrocarbyl polysulfides (see for example U.S. Pat. Nos. 2,237,625; 2,237,627; 2,527,948; 2,695,316; 3,022,351; 3,308,166; 3,392,201; 4,564,709; and British 1,162,334), functionally-substituted dihydrocarbyl polysulfides (see for example U.S. Pat. No. 4,218,332), and polysulfide olefin products (see for example U.S. Pat. No. 4,795,576). Other suitable examples include organo-sulfur compounds selected from sulfurized olefins, sulfur-containing amino heterocyclic compounds, 5-dimercapto-1,3,4-thiadiazole, polysulfides having a majority of S3 and S4 sulfides, sulfurized fatty acids, sulfurized branched olefins, organic polysulfides, and mixtures thereof.

In some embodiments the extreme pressure agent is present in the lubricating composition in an amount of up to about 3.0 wt % or up to about 5.0 wt %. In other embodiments, the extreme pressure agent is present from about 0.05 wt % to about 0.5 wt %, based on the total lubricant composition. In other embodiments, the extreme pressure agent is present from about 0.1 wt % to about 3.0 wt %, based on the total lubricant composition. In other embodiments the extreme pressure agent is present in an amount between about 0.6 wt % and about 1 wt %, based on the total lubricant composition. In yet other embodiments, the detergent is present in an amount of about 1.0 wt %, based on the total lubricant composition.

One suitable class of extreme pressure agents are polysulfides composed of one or more compounds represented by the formula: Ra-Sx-Rb where Ra and Rb are hydrocarbyl groups each of which may contain 1 to 18, and in other approaches, 3 to 18 carbon atoms and x is may be in the range of from 2 to 8, and typically in the range of from 2 to 5, especially 3. In some approaches, x is an integer from 3 to 5 with about 30 to about 60 percent of x being an integer of 3 or 4. The hydrocarbyl groups can be of widely varying types such as alkyl, cycloalkyl, alkenyl, aryl, or aralkyl. Tertiary alkyl polysulfides such as di-tert-butyl trisulfide, and mixtures comprising di-tert-butyl trisulfide (e.g., a mixture composed principally or entirely of the tri, tetra-, and pentasulfides) may be used. Examples of other useful dihydrocarbyl polysulfides include the diamyl polysulfides, the dinonyl polysulfides, the didodecyl polysulfides, and the dibenzyl polysulfides.

Another suitable class of extreme pressure agent is sulfurized isobutenes made by reacting an olefin, such as isobutene, with sulfur. Sulfurized isobutene (SIB), notably sulfurized polyisobutylene, typically has a sulfur content of from about 10 to about 55%, desirably from about 30 to about 50% by weight. A wide variety of other olefins or unsaturated hydrocarbons, e.g., isobutene dimer or trimer, may be used to form the sulfurized olefin extreme pressure agents. Various methods have been disclosed in the prior art for the preparation of sulfurized olefins. See, for example, U.S. Pat. No. 3,471,404 to Myers; U.S. Pat. No. 4,204,969 to Papay et al.; U.S. Pat. No. 4,954,274 to Zaweski et al.; U.S. Pat. No. 4,966,720 to DeGonia et al.; and U.S. Pat. No. 3,703,504 to Horodysky, et al, each of which his incorporated herein by reference.

Methods for preparing sulfurized olefins, including the methods disclosed in the aforementioned patents, generally involve formation of a material, typically referred to as an adduct", in which an olefin is reacted with a sulfur halide, for example, sulfur monochloride. The adduct is then reacted with a sulfur source to provide the sulfurized olefin. The quality of a sulfurized olefin is generally measured by various physical properties, including, for example, viscosity, sulfur content, halogen content and copper corrosion test weight loss. U.S. Pat. No. 4,966,720, relates to sulfurized olefins useful as extreme pressure additives in lubrication oils and to a two stage reaction for their preparation.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox® L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox® 4716 available from Albemarle Corporation.

Useful antioxidants may include diarylamines and phenols. In an embodiment, the lubricating oil composition may contain a mixture of a diarylamine and a phenol, such that each antioxidant may be present in an amount sufficient to provide up to about 5 wt %, based on the weight of the lubricant composition. In an embodiment, the antioxidant may be a mixture of about 0.3 wt % to about 1.5 wt % diarylamine and about 0.4 wt % to about 2.5 wt % phenol, based on the lubricant composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

The one or more antioxidant(s) may be present in ranges about 0 wt % to about 20 wt %, or about 0.1 wt % to about 10 wt %, or about 1 wt % to about 5 wt %, of the lubricating oil composition.

Dispersants

Dispersants contained in the lubricant composition may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,634,515, 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

In some embodiments, the additional dispersant may be derived from a polyalphaolefin (PAO) succinic anhydride, an olefin maleic anhydride copolymer. As an example, the additional dispersant may be described as a poly-PIBSA. In another embodiment, the additional dispersant may be derived from an anhydride which is grafted to an ethylene-propylene copolymer. Another additional dispersant may be a high molecular weight ester or half ester amide.

The additional dispersant, if present, can be used in an amount sufficient to provide up to about 10 wt %, based upon the final weight of the lubricating oil composition. Another amount of the dispersant that can be used may be about 0.1 wt % to about 10 wt %, or about 0.1 wt % to about 10 wt %, or about 3 wt % to about 8 wt %, or about 1 wt % to about 6 wt %, based upon the final weight of the lubricating oil composition.

Viscosity Index Improvers

The lubricant compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1, which is incorporated herein by reference.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, about 3 wt % to about 20 wt %, about 3 wt % to about 15 wt %, about 5 wt % to about 15 wt %, or about 5 wt % to about 10 wt %, of the lubricating oil composition.

In some embodiments, the viscosity index improver is a polyolefin or olefin copolymer having a number average molecular weight of about 10,000 to about 500,000, about 50,000 to about 200,000, or about 50,000 to about 150,000. In some embodiments, the viscosity index improver is a hydrogenated styrene/butadiene copolymer having a number average molecular weight of about 40,000 to about 500,000, about 50,000 to about 200,000, or about 50,000 to about 150,000. In some embodiments, the viscosity index improver is a polymethacrylate having a number average molecular weight of about 10,000 to about 500,000, about 50,000 to about 200,000, or about 50,000 to about 150,000.

Other Optional Additives

Other additives may be selected to perform one or more functions required of lubricant composition. Further, one or more of the mentioned additives may be multi-functional and provide functions in addition to or other than the function prescribed herein. The other additives may be in addition to specified additives of the present disclosure and/or may comprise one or more of metal deactivators, viscosity index improvers, ashless TBN boosters, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in optional amount sufficient to provide about 0 wt % to about 5 wt %, about 0.01 wt % to about 3 wt %, about 0.1 wt % to about 2 wt %, based upon the final weight of the lubricating oil composition.

The lubricant composition may also include corrosion inhibitors (it should be noted that some of the other mentioned components may also have copper corrosion inhibition properties). Suitable inhibitors of copper corrosion include ether amines, polyethoxylated compounds such as ethoxylated amines and ethoxylated alcohols, imidazolines, monoalkyl and dialkyl thiadiazole, and the like.

Thiazoles, triazoles and thiadiazoles may also be used in the lubricants. Examples include benzotriazole, tolyltriazole, octyltriazole, decyltriazole; dodecyltriazole, 2-mercaptobenzothiazole, 2,5-dimercapto-1,3,4-thiadiazole, 2-mercapto-5-hydrocarbylthio-1,3,4-thiadiazoles, and 2-mercapto-5-hydrocarbyldithio-1,3,4-thiadiazoles. In one embodiment, the lubricant composition includes a 1,3,4-thiadiazole, such as 2-hydrocarbyldithio-5-mercapto-1,3,4-dithiadiazole.

Anti-foam/Surfactant agents may also be included in a fluid according to the present invention. Various agents are known for such use. Copolymers of ethyl acrylate and hexyl ethyl acrylate, such as PC-1244, available from Solutia may be used. In other embodiments, silicone fluids, such as 4% DCF may be included. Mixtures of anti-foam agents may also be present in the lubricant composition.

EXAMPLES

The following examples are illustrative of exemplary embodiments of the disclosure. In these examples, as well as elsewhere in this application, all ratios, parts, and percentages are by weight unless otherwise indicated. It is intended that these examples are being presented for the purpose of illustration only and are not intended to limit the scope of the invention disclosed herein.

Example 1

EP Agent A: a di-tert-butyl polysulfide suitable for the short-chain polysulfide or the first polysulfide extreme pressure agent herein can be prepared as follows: a high-pressure reactor may be charged with aqueous sodium hydrosulfide and molten sulfur at a temperature of about 130° C. Isobutylene may then be added via a high pressure pump to the stirred mixture maintaining a reaction temperature of about 130° C. to about 170° C. Following the isobutylene charge the reaction may be heated to about 150° C. to about 170° C. for about 120 minutes. Next, heating may be stopped and the reactor allowed to cool to about 90° C. to about 100° C. while excess isobutylene may be vented off. The aqueous phase may be separated and the organic phase put under vacuum to remove residual water. The organic product may be filtered through diatomaceous earth as needed. Additional organic product may be recovered by extracting the aqueous by-product with several portions of hexane, combining the extracts, and evaporating the hexane.

The crude organic product may be combined with a 50 percent aqueous sodium hydroxide solution in a suitable flask equipped with a mechanical stirrer. This mixture may be stirred and heated to at least about 90° C. (or about 90° C. to about 110° C.) for 1 hour (or up to about 3 hours), allowed to cool, and then may be transferred to a separatory funnel. The aqueous phase can be removed and the organic product may be washed twice with water as needed. The organic product can be transferred to another flask, sparged with nitrogen, and optionally heated again to at least about 100° C. for up to about 1.5 hours. The organic product may be allowed to cool to room temperature under the nitrogen sparge and may then be filtered, if needed, through diatomaceous earth. Alternatively, the crude organic product can be distilled with collection of suitable fractions containing the prescribed trisulfide and disulfide content.

Exemplary short-chain di-tert-butyl polysulfides suitable for the first polysulfide extreme pressure agent can be made by the above process and may include a majority of trisulfides with about 43 to about 47 weight percent sulfur. Sulfide profiles can be determined by $^{13}$CNMR as described above.

EP Agent B: a di-tert-dodecyl polysulfide suitable for the long-chain polysulfide or the second polysulfide extreme pressure agent herein can be prepared as follows: a stainless-steel autoclave can be charged with sulfur and tert-dodecyl sulfide. Optionally, an amine or other suitable catalyst can be co-charged along with a non-reactive solvent, such as heptane or dichloro-methane. The reaction may be left to heat to temperatures between ambient (i.e., about 25° C.) and about 100° C. until all the elemental sulfur is consumed. Volatile organics may be removed by vacuum stripping and then the organic product containing di-tert-dodeyl polysulfides may be either treated with 50% caustic or fractionally distilled as described in Example 1 to obtain a predominantly trisulfide product.

Exemplary long-chain di-tert-dodecyl polysulfides suitable for the second polysulfide extreme pressure agent can be made by the above process and may include a majority of trisulfides with about 20 to about 23 weight percent sulfur. Sulfide profiles can be determined by 13CNMR as described above.

The first and the second polysulfide extreme pressure agents obtainable from the methods above for EP Agents A and B, respectively, were evaluated in lubricating compositions of Table 3 and tested for extreme pressure (ASTM D2596) and percent sulfur loss (ASTM D2893). The lubricating compositions of Table 3, in addition to the noted polysulfide extreme pressure agents, also included the same amounts of an additive package with the same detergents, friction modifiers, a viscosity modifier, an antioxidant, rust inhibitor, corrosion inhibitor, seal swell agent, and antifoam agents. The comparative and inventive compositions can also include the balance of base oils and/or process oils as needed to achieve a target KV100 of about 10 to 14 cSt.

TABLE 3

| | C-1 | C-2 | C-3 | I-1 | I-2 |
|---|---|---|---|---|---|
| EP Agent B, % S | 21.5 | 21.5 | 21.5 | 21.5 | 21.5 |
| EP Agent A, % S | 44.8 | 44.8 | 44.8 | 44.8 | 44.8 |
| EP Agent B, wt % | 0.5 | 0.7 | 0.9 | 1 | 1 |
| EP Agent A, wt % | 0.35 | 0.35 | 0.35 | 0.35 | 0.25 |
| % sulfur from polysulfides | 0.26 | 0.31 | 0.35 | 0.37 | 0.33 |
| Treat Rate Ratio* | 0.70 | 0.50 | 0.39 | 0.35 | 0.25 |
| % Sulfur Ratio** | 1.46 | 1.04 | 0.81 | 0.73 | 0.52 |
| % sulfur loss*** | 33 | 32 | 31 | 28 | 21 |
| 4 ball avg**** | — | — | — | 220 | 215 |
| | Fail | Fail | Fail | Pass | Pass |

*Treat Rate Ratio is weight percent of EP Agent A to weight percent of EP Agent B

**Sulfur Ratio is weight percent of sulfur from EP Agent A to weight percent of sulfur from EP Agent B

***Sulfur loss is measured by ICP before and after running an S200 oxidation test (ASTM D2893). % S loss is calculated as (SOT % S – EOT % S)/SOT % S * 100 with SOT - start of test and EOT - end of test.

****ASTM D2596 (Fresh lubricant before aging/oxidization test - greater than 200 kgf is desired)

As shown in table 3 above, only the lubricating compositions of Inventive Fluid 1 and 2 having the selected sulfur ratios from the blend of short-chain and long-chain polysulfide extreme pressure agents passed both the extreme pressure testing and maintained low sulfur loss below 30 percent. All comparative fluids had high levels of sulfur loss. It is preferred to have a 4-ball extreme pressure of at least about 200 kgf and, more importantly, controlling and minimizing sulfur loss after aging that could lead to a decrease in extreme pressure performance and/or tends to be undesired for various environmental shortcomings.

It is noted that, as used in this specification and the appended claims, the singular forms a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A lubricant composition comprising:

a) a first polysulfide extreme pressure agent comprising a mixture of C2-C6 polysulfides including a majority of trisulfides, wherein the first polysulfide has a structure of the formula $R_1$—$S_X$—$R_2$, wherein $R_1$ and $R_2$, are independently, a C2 to C6 hydrocarbyl group and x is an integer of at least 2 with a majority of x being 3;

b) a second polysulfide extreme pressure agent comprising a mixture of C10-C14 polysulfides including a majority of trisulfides, wherein the second polysulfide has a structure of the formula $R_3$—$S_X$—$R_4$, wherein $R_3$ and $R_4$, are independently, a C10 to C14 hydrocarbyl group and y is an integer of at least 2 with a majority of y being 3; and wherein a weight ratio of sulfur contributed by the first polysulfide and the second polysulfide is about 0.3 to about 0.8.

2. The lubricant composition of claim 1, wherein said first and said second polysulfide provide between about 0.2 to about 0.5 weight percent sulfur to the lubricating composition.

3. The lubricant composition of claim 2, wherein the first polysulfide has about 40 to about 50 weight percent sulfur and the second polysulfide has about 18 to about 30 weight percent sulfur.

4. The lubricant composition of claim 1, wherein the first polysulfide has about 1 to about 10 mol percent disulfide and about 51 to about 95 mol percent trisulfide.

5. The lubricant composition of claim 1, wherein the second polysulfide has about 1 to about 10 mol percent disulfide and about 51 to about 95 mol percent trisulfide.

6. The lubricant composition of claim 1, wherein $R_1$ and $R_2$, are independently, a C4 to C6 hydrocarbyl group.

7. The lubricant composition of claim 6, wherein $R_1$ and $R_2$ are each C4 hydrocarbyl groups.

8. The lubricant composition of claim 1, wherein the first polysulfide includes di-tert-butyl polysulfide.

9. The lubricant composition of claim 1, wherein $R_3$ and $R_4$ are each C12 hydrocarbyl groups.

10. The lubricant composition of claim 1, wherein the second polysulfide includes di-tert-dodecyl polysulfide.

11. The lubricant composition of claim 1, wherein the lubricant composition has less than about 30 weight percent sulfur loss as measured pursuant to ASTM D2893 and greater than about 200 kgf pursuant to a 4-ball test of ASTM D2596.

12. The lubricant composition of claim 1, further comprising about 0.2 to about 0.4 weight percent of the first polysulfide and about 0.8 to about 1.2 weight percent of the second polysulfide.

13. The lubricant composition of claim 12, further comprising a weight percent ratio of the first polysulfide to the second polysulfide of about 0.2 to about 0.38.

14. A method of lubricating a driveline, the method comprising lubricating a driveline component with a lubricating composition including a first polysulfide extreme pressure agent comprising a mixture of C2-$C_6$ polysulfides with a majority of trisulfides wherein the first polysulfide has a structure of the formula $R_1$—$S_X$—$R_2$, wherein $R_1$ and $R_2$, are independently, a C2 to C6 hydrocarbyl group and x is an integer of at least 2 with a majority of x being 3, and a second polysulfide extreme pressure agent comprising a mixture of C10-C14 polysulfides with a majority of trisulfides, wherein the second polysulfide has a structure of the formula $R_3$—$S_y$—$R_4$, wherein $R_3$ and $R_4$, are independently, a C10 to C14 hydrocarbyl group and y is an integer of at least 2 with a majority of y being 3, and wherein a weight ratio of sulfur contributed by the first polysulfide and the second polysulfide is about 0.3 to about 0.8.

15. The method of claim 14, wherein said first and said second polysulfide provide between about 0.2 to about 0.5 weight percent sulfur to the lubricating composition.

16. The method of claim 14, wherein $R_1$ and $R_2$, are independently, a C4 to C6 hydrocarbyl group.

17. The method of claim 14, wherein the first polysulfide includes di-tert-butyl polysulfide.

18. The method of claim 17, wherein the second polysulfide includes di-tert-dodecyl polysulfide.

19. The method of claim 14, wherein the lubricant composition has less than about 30 weight percent sulfur loss as measured pursuant to ASTM D2893 and greater than about 200 kgf pursuant to a 4-ball test of ASTM D2596.

20. The method of claim 18, wherein the lubricant composition has less than about 30 weight percent sulfur loss as measured pursuant to ASTM D2893 and greater than about 200 kgf pursuant to a 4-ball test of ASTM D2596.

* * * * *